US008226125B2

(12) United States Patent
Williams et al.

(10) Patent No.: US 8,226,125 B2
(45) Date of Patent: Jul. 24, 2012

(54) SECURITY DOCUMENT

(75) Inventors: Wendy Victoria Williams, Swaythling (GB); Julia Ruth Dean, Eastleigh (GB)

(73) Assignee: De La Rue International Limited, Hampshire (GB)

( * ) Notice: Subject to any disclaimer, the term of this patent is extended or adjusted under 35 U.S.C. 154(b) by 981 days.

(21) Appl. No.: 12/087,512

(22) PCT Filed: Jan. 23, 2007

(86) PCT No.: PCT/GB2007/000214

§ 371 (c)(1),
(2), (4) Date: Aug. 27, 2008

(87) PCT Pub. No.: WO2007/085808

PCT Pub. Date: Aug. 2, 2007

(65) Prior Publication Data

US 2009/0045618 A1 Feb. 19, 2009

(30) Foreign Application Priority Data

Jan. 26, 2006 (GB) ..... 0601635.6

(51) Int. Cl.
*B42D 15/00* (2006.01)

(52) U.S. Cl. ..... 283/94; 283/72

(58) Field of Classification Search ..... None
See application file for complete search history.

(56) References Cited

U.S. PATENT DOCUMENTS

| | | | | |
|---|---|---|---|---|
| 4,652,015 | A | 3/1987 | Crane | |
| 2002/0027361 | A1 | 3/2002 | Hardwick et al. | |
| 2007/0132227 | A1 * | 6/2007 | Dean | 283/72 |

FOREIGN PATENT DOCUMENTS

| | | | |
|---|---|---|---|
| EP | 0 388 090 | A1 | 9/1990 |
| EP | 1 415 828 | | 5/2004 |
| WO | WO 83/00659 | A1 | 3/1983 |
| WO | WO 95/10419 | A1 | 4/1995 |
| WO | WO 95/10420 | A1 | 4/1995 |
| WO | WO 97/47478 | A1 | 12/1997 |
| WO | WO 00/39391 | A1 | 7/2000 |
| WO | WO 03/054297 | A2 | 7/2003 |

* cited by examiner

*Primary Examiner* — Joanne Silbermann
(74) *Attorney, Agent, or Firm* — Oliff & Berridge, PLC

(57) ABSTRACT

A security document has a first region and an adjacent second region, the regions defining a security device. Opposite sides of the first region are provided with first and second, complementary indicia registered with respect to one another, the first region being sufficiently transparent that both the first and second indicia are viewable from either side of the document under reflected light. Third indicia are provided on the second region on the same side of the document, registered with, and complementary to, the first indicia, and fourth indicia are provided on the second region on the same side of the document, registered with, and complementary to, the second indicia, the third and fourth indicia also being complementary to and registered with respect to one another. The second region is sufficiently opaque such that when the document is viewed under reflected light only the third and fourth indicia facing the observer are visible, but is sufficiently transparent when the document is viewed from either side under transmitted light, both the third and fourth indicia are visible.

Figure 1:
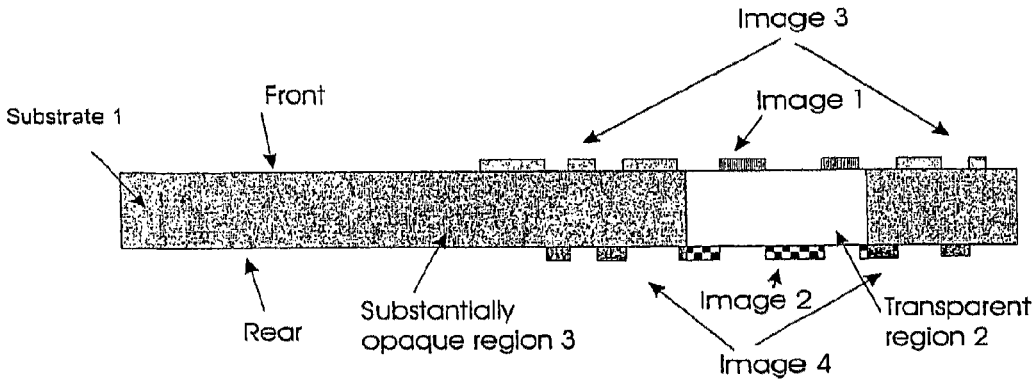

22 Claims, 6 Drawing Sheets a b

SECURITY DOCUMENT

The invention relates to a security document incorporating a security device.

A variety of security devices have been proposed in the past to prevent security documents from being counterfeited or fraudulently produced. A particularly useful security device is one which is readily verifiable by a user but which is difficult to produce. An example of such a security device is a "see-through" feature in which complementary images are provided on each side of a document precisely registered relative to one another such that when the document is held up to the light, the image on the back will fit exactly into spaces within the image on the front. For example, each image could comprise a series of coloured segments, segments on one side of the sheet fitting within the spaces between the segments on the other. Printing of these images is normally carried out with specialised lithographic presses which allow simultaneous front and back printing during one printing run. See-through features have four modes of visual inspection—the first image viewed in reflected light, the image on the other side of the document viewed in reflected light, the composite image viewed by transmitted light as viewed from the first side and with the image on that side predominating, and finally the composite image as viewed on the other side of the sheet with the image on that side predominating. On transmissive viewing of see-through features the image on the opposite side of the document is seen to be in register in a genuine document.

See-through features have been described within the prior art for example EP 388090, WO 9747478, and EP 1415828.

A problem with these conventional "see-through" features is that by their nature, the see-through effect can only be seen when the document is viewed in transmitted light and this reduces the ease by which the feature can be verified, particularly in situations where the verifier may not be particularly skilled or have time to make a detailed inspection of the document.

In accordance with the present invention, a security document has a first region and an adjacent second region, the regions defining a security device wherein opposite sides of the first region are provided with first and second, complementary indicia registered with respect to one another, the first region being sufficiently transparent that both the first and second indicia are viewable from either side of the document under reflected light, wherein third indicia are provided on the second region on the same side of the document, registered with, and complementary to, the first indicia, and wherein fourth indicia are provided on the second region on the same side of the document, registered with, and complementary to, the second indicia, the third and fourth indicia also being complementary to and registered with respect to one another, the second region being sufficiently opaque such that when the document is viewed under reflected light only the third or fourth indicia facing the observer are visible, but being sufficiently transparent that when the document is viewed from either side under transmitted light, both the third and fourth indicia are visible.

For convenience, the first and second regions will be referred to as "transparent" and "substantially opaque" respectively although these terms must be construed in accordance with the definition of the invention in the claims. Further, for the avoidance of doubt, opposite sides is intended to mean the front and back sides of the security document.

We have devised an improved see-through feature which is much more readily usable and verifiable by placing part of the feature in a first transparent region of the document so that the indicia on both sides of the region can be viewed in reflected light.

The present invention provides a more secure front-to-back registration device where any mis-registration can be easily observed in both reflection and transmission because the complementary indicia on either side of the document are formed partly over a transparent region and partly over a substantially opaque region.

The result of this is that the authenticity of the document can be checked in a number of ways:

1. By viewing the front or back of the document in reflection to check the front to back registration between the complementary indicia printed on opposites sides of the transparent first region.
2. By viewing the front of the document in reflection to check the registration between the composite image (formed by the first and second indicia) in the transparent first region with the complementary third indicia on the opaque second region.
3. By viewing the back of the document in reflection to check the registration between the first composite image (formed by the first and second indicia) in the transparent first region with the complementary fourth indicia on the opaque second region.
4. By viewing the document in transmission to view the composite image formed by the first, second, third and fourth indicia and therefore checking the front to back registration of the complementary images (indicia 1-4) in both the opaque and transparent regions.

Examples of security documents with which the present invention can be used include banknotes, fiscal stamps, cheques, postal stamps, certificates of authenticity, articles used for brand protection, bonds, payment vouchers, and the like.

The security document may have a substrate formed from any conventional material including paper and polymer. Techniques are known in the art for forming transparent regions in each of these types of substrate. For example, WO 8300659 describes a polymer banknote formed from a transparent substrate comprising an opacifying coating on both sides of the substrate. The opacifying coating is omitted in localised regions on both sides of the substrate to form a transparent region.

WO 0039391 describes a method of making a transparent region in a paper substrate.

Other methods for forming transparent regions in paper substrates are described in EP 723501, EP 724519 and WO 03054297.

The indicia are preferably in the form of images such as patterns, symbols and alphanumeric characters and combinations thereof. The indicia can be defined by patterns comprising solid or discontinuous regions which may include for example line patterns, fine filigree line patterns, dot structures and geometric patterns. Possible characters include those from non-Roman scripts of which examples include but are not limited to, Chinese, Japanese, Sanskrit and Arabic. The radiation used for viewing the indicia would typically be in the visible light range but could include radiation outside the visible range such as infrared or ultraviolet. The first and second indicia may define complementary patterns and conveniently gaps between elements of the first indicia may be filled by elements of the second indicia when viewed in reflection or transmission. This makes registration between the two indicia easy to verify.

Similarly, the third and fourth indicia may comprise complementary patterns and again gaps between elements of the third indicia may be filled by elements of the fourth indicia when viewed in transmission.

The first and third indicia may also comprise complementary patterns and for example they may be complementary in the sense that they extend along concentric arcs.

In a similar way, the second and fourth indicia may comprise complementary patterns, for example extending along concentric arcs.

Other complementary combinations are possible, for example the first and third indicia may define a sequence of alphanumeric characters, for example defining a word, so that the overall appearance of a composite image is one which extends across the first and second regions. The second and fourth indicia may be defined in a similar manner.

In further examples the individual indicia may not form a recognizable image but the combination of some or all of the indicia forms a recognizable image which can be a piece of identifiable information for example the national flag of a country or an alphanumeric character. The formation of a recognizable image on combination of the first and third or second and fourth indicia facilitates the authenticator in identifying counterfeits that do not exhibit perfect registration.

In a further complementary combination the indicia comprise line patterns or an array of geometric shapes. For example the first and third indicia comprises a first array of fine lines and the second and fourth indicia comprises a second array of fine lines corresponding to the first array in that the arrays are superimposed but with at least some regions of the first array of fine lines being offset from the second array of lines. The offset areas result in regions of variable density which can display identifying information when viewed in either reflection or transmission in the transparent first region and in transmission in the second opaque region.

In a further embodiment the indicia are defined in more than one colour. Further enhancements can be achieved by providing overlapping regions of the first indicia and second indicia and the third and fourth indicia in different colours. By providing the first and second indicia in blocks of different colours, a further colour will appear in the transparent first region where there is overlap resulting from the combination of the two colours. By providing the third and fourth indicia in blocks of different colours, a further colour will appear in the opaque second region where there is overlap resulting from the combination of the two colours.

Typically, the indicia are printed onto the document. Any of the indicia could be printed using lithography, UV cured lithography, intaglio, letterpress, flexographic printing, gravure printing or screen printing. The indicia can be provided using conventional inks such as coloured inks, white inks, black inks, metallic inks, optically variable inks (such as those incorporating thin film optical interference filters or liquid crystal pigment) and the like. Thermochromic inks, photochromic inks, magnetic inks, infrared absorbing inks and fluorescing and phosphorescing inks may also be employed. The inks may be employed in rainbow printing fashion.

In a preferred embodiment, all four indicia are simply printed in one process ensuring perfect registration between the indicia. However, in a second embodiment, the first and second indicia may be applied using different processes to the third and fourth indicia in order to optimize the adhesion of the ink/coating to the substrate. For example, the substantially opaque second region may be printed with conventional litho printing inks and the transparent first region may be printed with UV curable litho printing inks. In this case, the registration between the first and second regions must be tightly controlled in order that the two complementary indicia combine to form the respective composite images.

The transparent first region of the security device of the current invention can be formed by creating a transparent region in a paper substrate. The preferred method for creating a transparent region in a paper substrate is described in WO0039391 in which one side of a transparent elongate impermeable strip is wholly exposed at one surface of a paper substrate in which it is partially embedded, and partially exposed in apertures at the other surface of the substrate. The apertures formed in the paper can be used as the first transparent region in the current invention.

In the method described in WO0039391 the first and/or second indicia can be applied to the first transparent regions during the production of the transparent elongate impermeable strip. Preferably the first and/or second indicia can be created using known metallisation or demetallisation processes. It is known that metallised films can be produced such that no metal is present in controlled and clearly defined areas. Such partly metallised film can be made in a number of ways. One way is to selectively demetallise regions using a resist and etch technique such as is described in U.S. Pat. No. 4,652,015. Other techniques are known for achieving similar effects; for example it is possible to vacuum deposit aluminium through a mask or aluminium can be selectively removed from a composite strip of a plastic support and aluminium using an excimer laser. In one example both the first and second indicia can be created using a demetallised vapour deposited metallic film or alternatively the first indicia can be created from a metallised film and the second indicia can be printed by conventional methods either before or after the transparent film is incorporated into the paper substrate.

An example of a banknote according to the invention will now be described with reference to the accompanying drawings, in which:—

Figure 2:
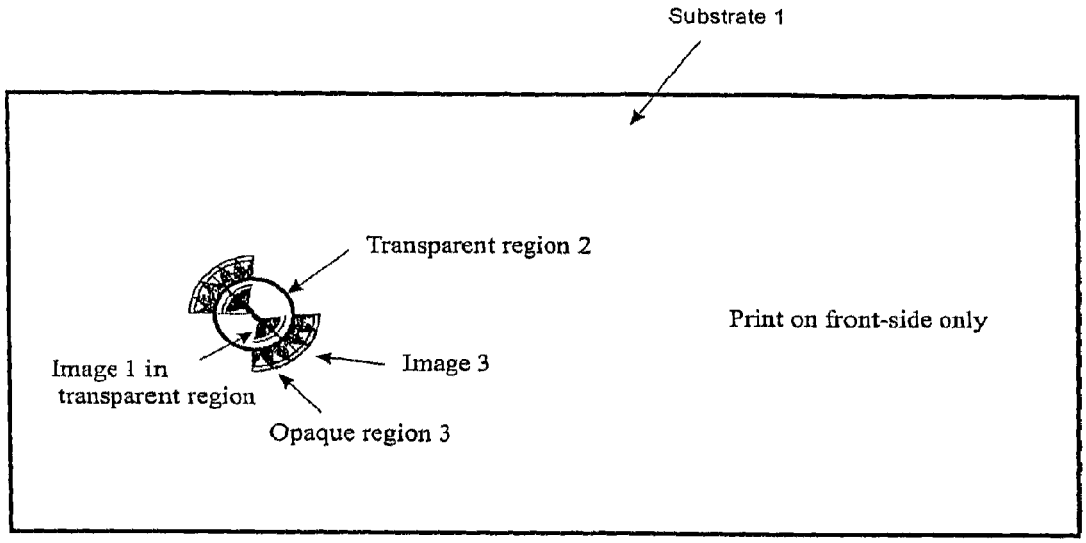
Figure 2:
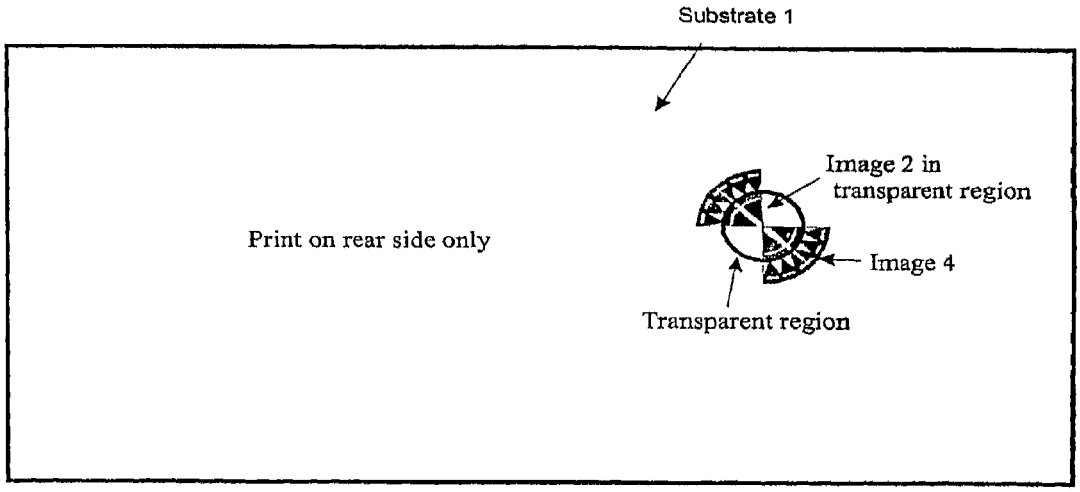
Figure 3:
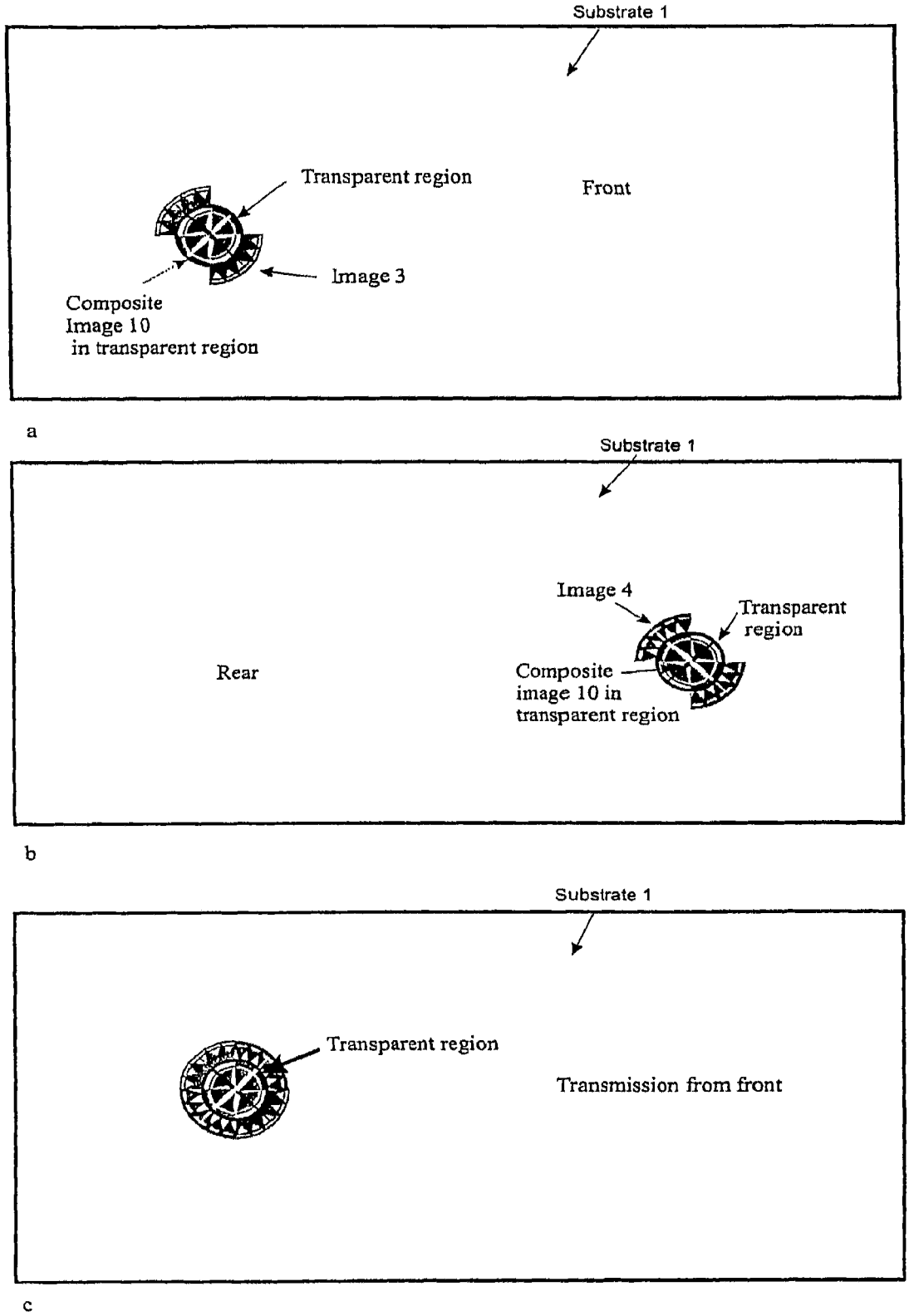
Figure 4:
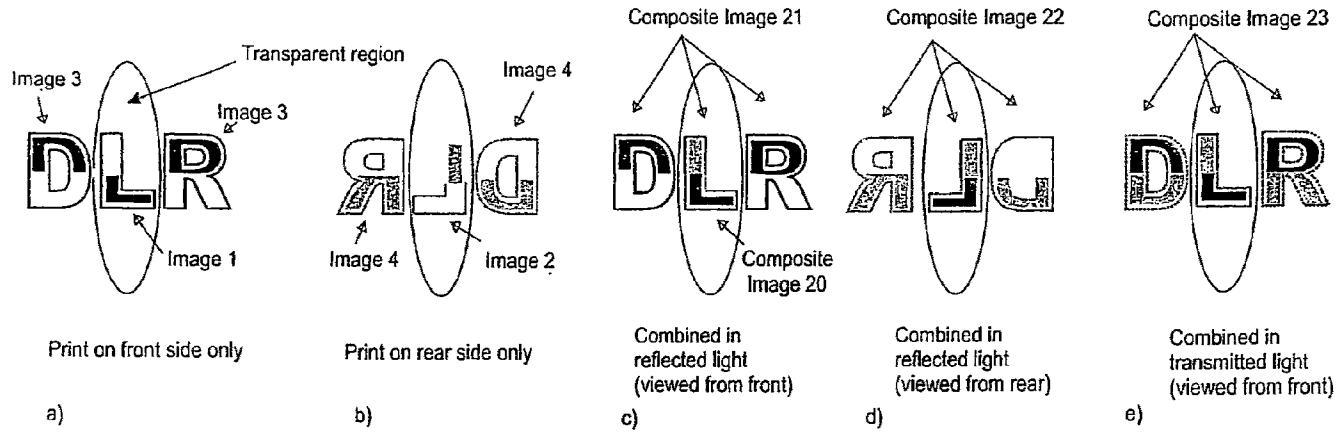

FIG. 1 is a schematic cross-section through part of the banknote;

FIG. 2*a* illustrates the part of the security device printed on the front side of the banknote;

FIG. 2*b* illustrates the part of the security device printed on the rear side of the banknote;

FIG. 3*a* illustrates the appearance of the security device when viewed under reflected light from the front of the banknote;

FIG. 3*b* illustrates the appearance of the security device when viewed under reflected light from the rear of the banknote; and, FIG. 3*c* illustrates the appearance of the security device when viewed in transmission from the front.

FIGS. 4-7 illustrate further examples in which the indicia may be complementary.

The banknote shown in FIG. 1 comprises a substrate 1 which may be paper or polymer, in this case paper. The substrate defines front and rear sides and has a first region 2 formed as a transparent window surrounded by a substantially opaque second region 3. The transparent region 2 may have been formed using any of the conventional methods described above.

On the front side of the transparent region 2, first indicia defining "Image 1" are printed.

On the rear side of the transparent region 2 are printed second indicia defining "Image 2". As can be seen in FIG. 1, Images 1 and 2 define a see-through feature in which the elements of Image 1 fall within the gaps between the elements of Image 2 and vice versa.

Third indicia defining "Image 3" are printed on the front side of the substrate 1 on the substantially opaque region 3 adjacent the transparent region 2. Similarly, fourth indicia defining "Image 4" are printed on the rear side of the substrate 1 on the substantially opaque region 3 adjacent the transparent region 2.

Image 3 and Image 4 are complementary to one another as can be seen in FIG. 1 in which the elements of Image 4 fall within the gaps between the elements of Image 3.

In addition, Image 1 is complementary to and registered with Image 3 while Image 2 is complementary to and registered with Image 4. This can be seen more clearly in FIGS. 2*a* and 2*b*. It should be noted that the bold circular line in FIGS. 2 and 3 marks the boundary of the transparent region 2 and is not part of the design.

FIG. 2*a* shows Images 1 and 3 printed on the front side of the substrate 1 and it will be seen that these images are complementary in the sense that they extend along concentric arcs with a constant, defined gap between them.

Similarly, FIG. 2*b* illustrates Image 2 and Image 4 printed on the rear side of the banknote 1 and again it can be seen that the two images extend along concentric arcs.

FIG. 3*a* illustrates the appearance of the device when viewed from the front side under reflected light. Images 1 and 2 combine together, because they are on opposite sides of the transparent region 2, to form a first composite Image 10. In addition, the viewer can see Image 3 which is printed on the opaque region 3 on the front side of the substrate 1. FIG. 3*a* illustrates that when viewing from the front side in reflection, the first composite Image 10 in the transparent region 2 is seen to continue into the complementary Image 3 in the opaque region to form a second composite Image.

In the same way, when viewing the rear of the document in reflection (FIG. 3*b*), the first composite Image 10 in the transparent region can be seen together with the Image 4, the first composite Image 10 being seen to continue into the complementary Image 4 in the opaque region to form a third composite Image.

Therefore in reflection there are two registration requirements, firstly the front to back registration in the transparent first region and secondly the registration of the composite image formed in the transparent region with the images on the adjacent substantially opaque second regions. This double aspect prevents the counterfeiter from simply forming the front and back images on the transparent region on the same side of the document because there is still the requirement that the counterfeit composite image in the transparent region must be registered to the image in the opaque region on the opposite side of the document.

Finally, when viewed in transmission, the fourth composite Image is observed (FIG. 3*c*) which is created as a result of the registration of all Images 1-4 on the front and back of the substrate. Images 3 and 4 can both be seen in transmission because the opaque region 3 allows some light to pass through.

FIGS. 4*a*-*e* show a further example of complementary images. FIG. 4*a* shows Images 1 and 3 printed on the front side of the substrate 1 and similarly FIG. 4*b* shows Images 2 and 4 printed on the rear side of the substrate 1. FIG. 4*c* illustrates the appearance of the device when viewed from the front side under reflected light. Images 1 and 2 combine together, because they are on opposite sides of the transparent region 2, to form a first composite Image 20. In addition, the viewer can see Image 3 which is printed on the front side of the substrate 1. FIG. 4*c* illustrates that when viewing from the front side in reflection, the first composite Image 20 in the transparent region 2 and Image 3 form the sequence of alphanumeric characters DLR, defined by their perimeter lines, which extend across the first and second regions forming a second composite Image 21.

In the same way, when viewing the rear of the document in reflection (FIG. 4*d*), the first composite Image 20 in the transparent region 2 can be seen together with the Image 4 to form the third composite Image 22 defining the alphanumeric characters DLR extending across the first and second regions.

Finally, when viewed in transmission, the fourth composite Image 23 is observed which is created as a result of the registration of all Images 1-4 on the front and rear of the substrate. In this example the colour segments from Images 3 and 4 combine to fill the letters D and R such that all the letters D L R are now filled with related patterns. FIG. 4*e* shows composite Image 23 when viewed from the front of the substrate.

FIGS. 5*a*-*e* show a similar series of complementary images to that shown in FIGS. 4*a*-*e*, but in this case the edge of the transparent region is designed to pass through the alphanumeric characters D and R. In this example Image 1 now comprises the top half of the outline of the letter L and the bottom half partly infilled and part of the outline and infill of the letters D and R. Image 3 comprises the remaining part of the outline of the letters D and R and a further part of the infill of the letters D and R. Image 2 comprises the bottom half of the outline of the letter L and the top half partly infilled and part of the outline and infill of the letters D and R. Image 4 comprises the remaining part of the outline of the letters D and R and a further part of the infill of the letters D and R. The fact that the letters D and R continue across the boundary between Images 1 and 3 and Images 2 and 4 increases the registrational requirement between the print on the first transparent region and the second opaque region because any misregistration, revealed by the incomplete formation of the letters D and R, will be easily recognised by the general public.

Figure 5:
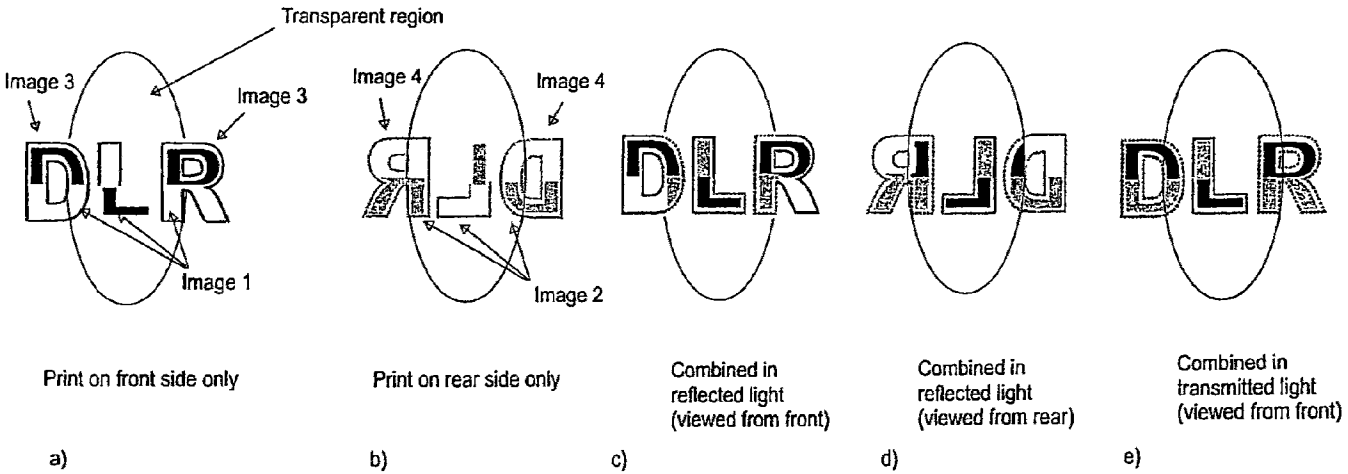
Figure 6:
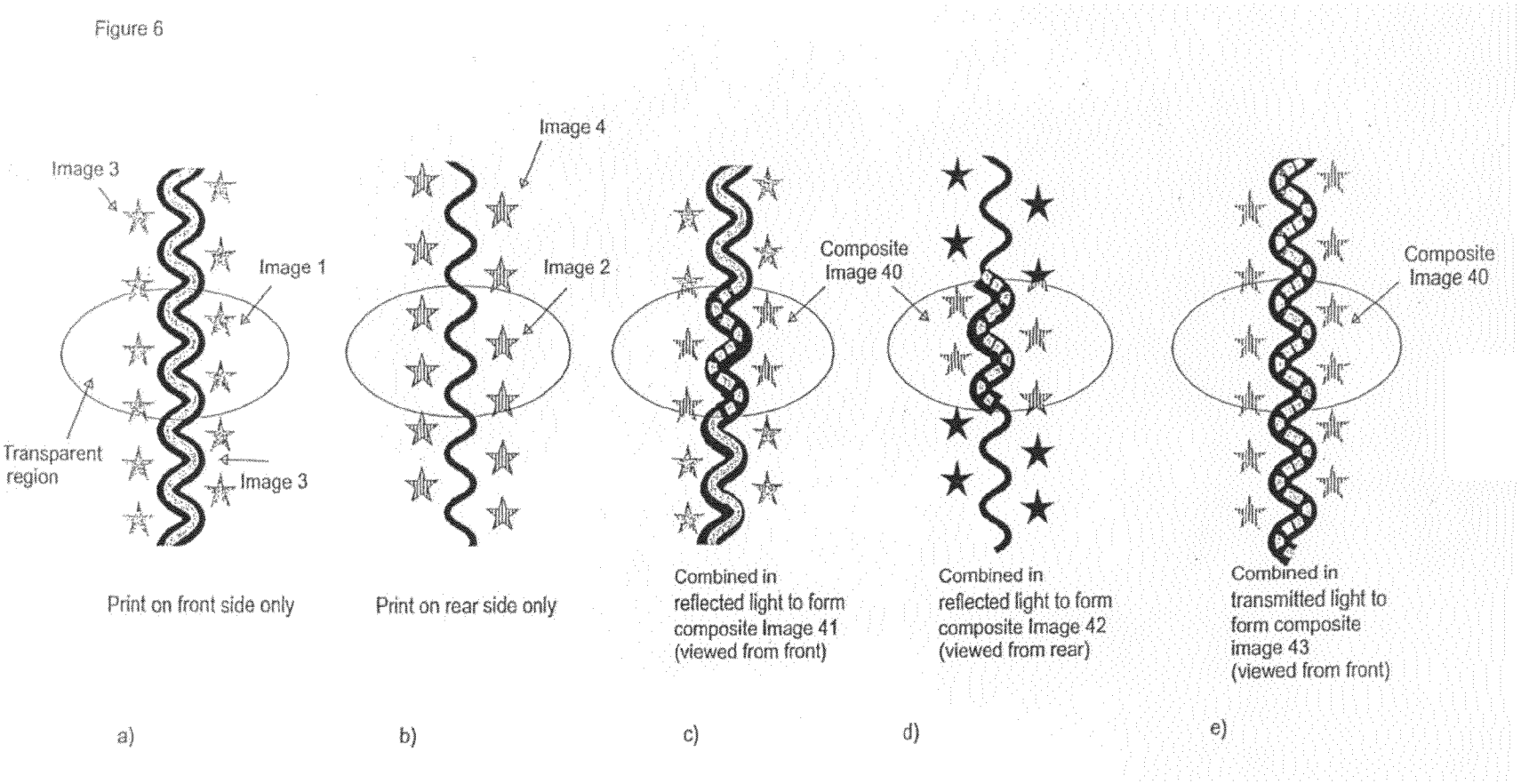

A further advantage of the design shown in FIG. 5 is that the position of the transparent region relative to the print might not be fixed and therefore a degree of freedom is allowed in the registration of the printed images to the position of the transparent region. This is particularly important if the transparent region is created during the production of a paper substrate and Images 1-4 are subsequently applied simultaneously across the opaque and transparent regions using a double-sided offset lithographic press. In this case there is a natural tendency for the position of the transparent region to wander and in addition there is typically not a sharply defined boundary between the opaque region and the transparent region due to the irregular nature of the paper fibre deposition during papermaking.

In a further embodiment the indicia of the current invention are associated with further indicia on either side of the substrate either within or adjacent to the transparent or opaque regions. This increases the difficulty for counterfeiters to duplicate an item carrying the security device since they must associate the device with the further indicia. The further indicia can be provided using conventional inks such as coloured inks, white inks, black inks, metallic inks, optically variable inks (such as those incorporating thin film optical interference filters or liquid crystal pigment) and the like. Thermochromic inks, photochromic inks, magnetic inks, infrared absorbing inks and fluorescing and phosphorescing inks may also be employed. Alternatively the further indicia can be provided by metallised/demetallised designs, holographic designs, liquid crystal films or security embossings of transparent films. For example, considering the illustration shown in FIG. 5, the printed letter L formed by the front to back registration of parts of Image 1 and 2 in the transparent region could be replaced with a letter L formed from a holographic grating on the front side of the transparent region.

FIGS. 6*a-e* show a further example of complementary images. FIG. 6*a* shows that Image 1, on the front side of the substrate in the transparent region, is a repeating pictorial image which continues in substantially perfect register into Image 3. Image 2, on the rear side of the substrate in the transparent region, is also a repeating pictorial image which continues in substantially perfect register into Image 4 (FIG. 6*b*). Front to back registration between Images 1 and 2 forms composite Image 40, shown in FIGS. 6*c*-6*e*, in the transparent region. By providing parts of Images 1 and 2 in different colours, a further resultant colour will appear in transmission or reflection where there is overlap resulting from the combination of the two colours. For example yellow stars in Image 1 perfectly overlap with the red stars in Image 2 to from orange stars in the first transparent region. On viewing the device from the front side of the substrate in reflection composite Image 40 combines with Image 3 to form further composite Image 41 (FIG. 6*c*). Similarly on viewing the device from the rear side of the substrate in reflection composite Image 40 combines with Image 4 to form further composite Image 42 (FIG. 6*d*). Finally when viewing in transmission the combination of Images 3 and 4 in register with the combination of Images 1 and 2 forms a further composite Image 43, shown when viewed from the front of the document in FIG. 6*e*. By providing parts of Images 3 and 4 in different colours a further, resultant colour will appear when the superimposed regions of 3 and 4 are viewed in transmission. Security is enhanced because when viewed in transmission Images 3 and 4 not only cooperate in the overlapping areas to define a composite image but in addition form that image in a third colour different from the colours of the first and second Image respectively. The resultant colours produced by the combinations of Images 1 and 2 and Images 3 and 4 will typically be different but could be the same.

Figure 7:
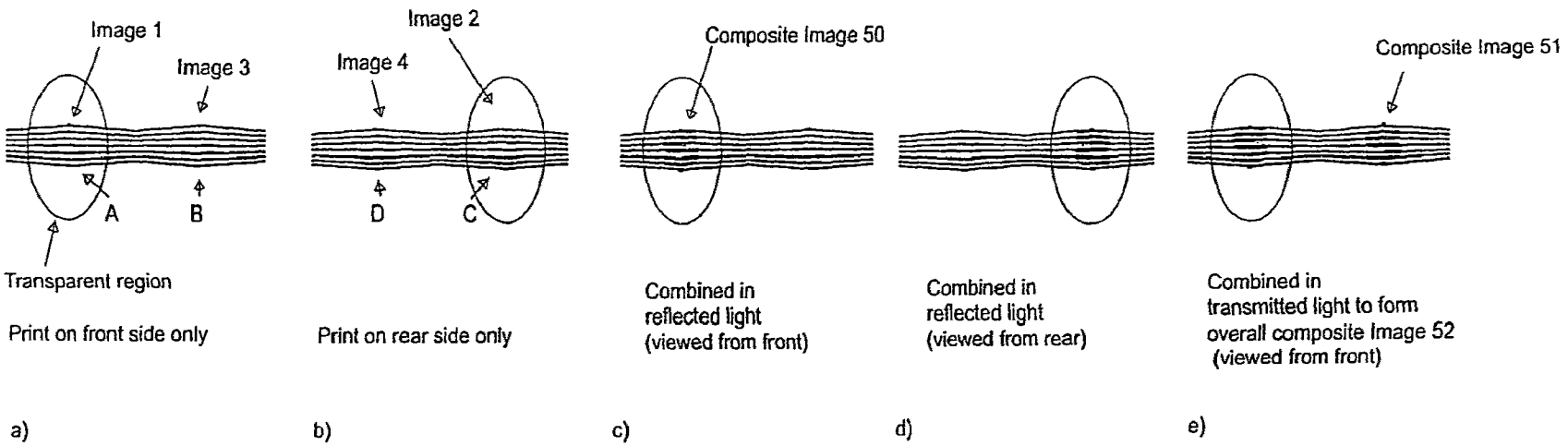

FIGS. 7*a-e* show a further example of complementary images. Image 1 and Image 3, on the front of the substrate, comprise a first array of fine lines and Image 2 and Image 4, on the rear of the substrate, comprise a second array of fine lines. The array of lines on the front of the substrate is regular apart from in position A (Image 1) and position B (Image 3) where the thickness of the lines has been increased above the normal line position (FIG. 7*a*). The array of lines on the rear of the substrate is regular apart from in position C (Image 2) and position D (Image 4) where the thickness of the lines has been increased below the normal line position (FIG. 7*b*). The two arrays of fine lines are registered such that positions A and C and positions B and D are superimposed. The fact that the lines are offset in the positions where the thickness has been altered result in regions of variable density, which if the registration is correct, display identifying information in the form of a $ symbol when viewed from the front of the substrate in either reflection or transmission in the transparent first region (composite Image 50, FIG. 7*c*) and in transmission in the opaque second region (composite Image 51, FIG. 7*e*). When viewed in transmission both composite Images 50 and 51 are visible to give a further composite Image 52 (FIG. 7*e*). The example shown in FIG. 7 requires tight registrational control between Images 1 and 2 and between Images 3 and 4 on the front and rear of the document and also between Images 1 and 3 and Images 2 and 4 across the opaque and transparent regions. A counterfeit exhibiting poor registration in either of these two respects will be easily identifiable by the general public when viewed in either reflection or transmission.

The invention claimed is:

1. A security document having a first region and an adjacent second region, the regions defining a security device wherein opposite sides of the first region are provided with first and second, complementary indicia registered with respect to one another, the first region being sufficiently transparent that both the first and second indicia are viewable from either side of the document under reflected light, wherein third indicia are provided on the second region on the same side of the document, registered with, and complementary to, the first indicia, and wherein fourth indicia are provided on the second region on the same side of the document, registered with, and complementary to, the second indicia, the third and fourth indicia also being complementary to and registered with respect to one another, the second region being sufficiently opaque such that when the document is viewed under reflected light only the third or fourth indicia facing the observer are visible, but being sufficiently transparent that when the document is viewed from either side under transmitted light, both the third and fourth indicia are visible.

2. A document according to claim 1, wherein the substrate is one of paper or polymer.

3. A document according to claim 1, wherein the first region is defined by a transparent window formed in the document.

4. A document according to claim 1, wherein the first and second indicia define complementary patterns.

5. A document according to claim 4, wherein gaps between elements of the first indicia are filled by elements of the second indicia when viewed in transmission or reflection.

6. A document according to claim 1, wherein the first and second indicia overlap when viewed in transmission, their colours combining to product a resultant colour.

7. A document according claim 1, wherein the third and fourth indicia define complementary patterns.

8. A document according to claim 7, wherein gaps between elements of the third indicia are filled by elements of the fourth indicia when viewed in transmission.

9. A document according to claim 1, wherein the third and fourth indicia overlap when viewed in transmission, their colours combining to produce a resultant colour.

10. A document according to claim 9, wherein the first and second indicia overlap when viewed in transmission, their colours combining to product a resultant colour and the resultant colour produced by the first and second indicia is different from the resultant colour produced by the third and fourth indicia.

11. A document according to claim 1, wherein the first and third indicia are complementary to one another.

12. A document according to claim 11, wherein the first and third indicia extend along concentric arcs.

13. A document according to claim 1, wherein the second and fourth indicia define complementary patterns.

14. A document according to claim 13, wherein the patterns extend along concentric arcs.

15. A document according to claim 1, wherein the indicia define one of more of alphanumeric characters, pictorial images, symbols and non-Roman scripts, such as Chinese, Japanese, Sanskrit and Arabic.

16. A document according to claim 1, wherein the indicia are defined by patterns comprising solid or discontinuous regions.

17. A document according to claim 16, wherein the patterns comprise line patterns, fine filigree line patterns, dot structures and/or geometric patterns.

18. A document according to claim 1, wherein the indicia are printed onto a substrate of the document.

19. A document according to claim 18, wherein the first and third indicia and/or the second and fourth indicia are printed simultaneously onto the document.

20. A document according to claim 18, wherein the printing process is one of lithography, UV cured lithography, intaglio, flexographic, gravure or screen printing.

21. A document according to claim 1, wherein some or all of the indicia are created using a metallization or dematillisation process.

22. A document according to claim 1, wherein the document is one of a banknote, cheque, fiscal stamp, voucher, passport, identity card, and certificate of authenticity.

* * * * *